United States Patent [19]

Gosden

[11] 3,948,034

[45] Apr. 6, 1976

[54] FALSE TWISTING FILAMENTARY YARNS

[75] Inventor: Raymond George Gosden, Pontypool, England

[73] Assignee: Imperial Chemical Industries Limited, London, England

[22] Filed: Apr. 26, 1974

[21] Appl. No.: 465,141

[30] Foreign Application Priority Data

Apr. 27, 1973 United Kingdom..... 20152/73

[52] U.S. Cl. ..... 57/157 TS; 57/77.4

[51] Int. Cl.[2] ..... D02G 1/02; D02G 1/20

[58] Field of Search ..... 57/77.3, 77.4, 157 TS, 57/77.45, 157 S, 156

[56] References Cited

UNITED STATES PATENTS

| | | | |
|---|---|---|---|
| 3,066,473 | 12/1962 | Maeda | 57/77.4 |
| 3,581,487 | 6/1971 | Loomes et al. | 57/77.4 |
| 3,656,290 | 4/1972 | Kuussaari | 57/77.4 X |
| 3,668,855 | 6/1972 | Leeson | 57/77.4 |
| 3,668,856 | 6/1972 | Richter | 57/156 |
| 3,670,488 | 6/1972 | Richter | 57/77.4 |
| 3,701,245 | 10/1972 | Richter | 57/77.4 X |
| 3,782,088 | 1/1974 | Bakewell | 57/77.4 X |
| 3,813,867 | 6/1974 | Ivanto | 57/77.4 |
| 3,846,966 | 11/1974 | Peacock | 57/157 TS X |

*Primary Examiner*—Donald E. Watkins
*Attorney, Agent, or Firm*—Cushman, Darby & Cushman

[57] ABSTRACT

A method for false twisting filamentary yarn using a friction false twist device comprising a rotatable hollow spindle with a friction surface or bush mounted at one end thereof.

4 Claims, 6 Drawing Figures

FALSE TWISTING FILAMENTARY YARNS

The present invention relates to the false twisting of filamentary yarns and in particular to methods for friction false twisting such yarns.

IN THE DRAWINGS

Figure 1:
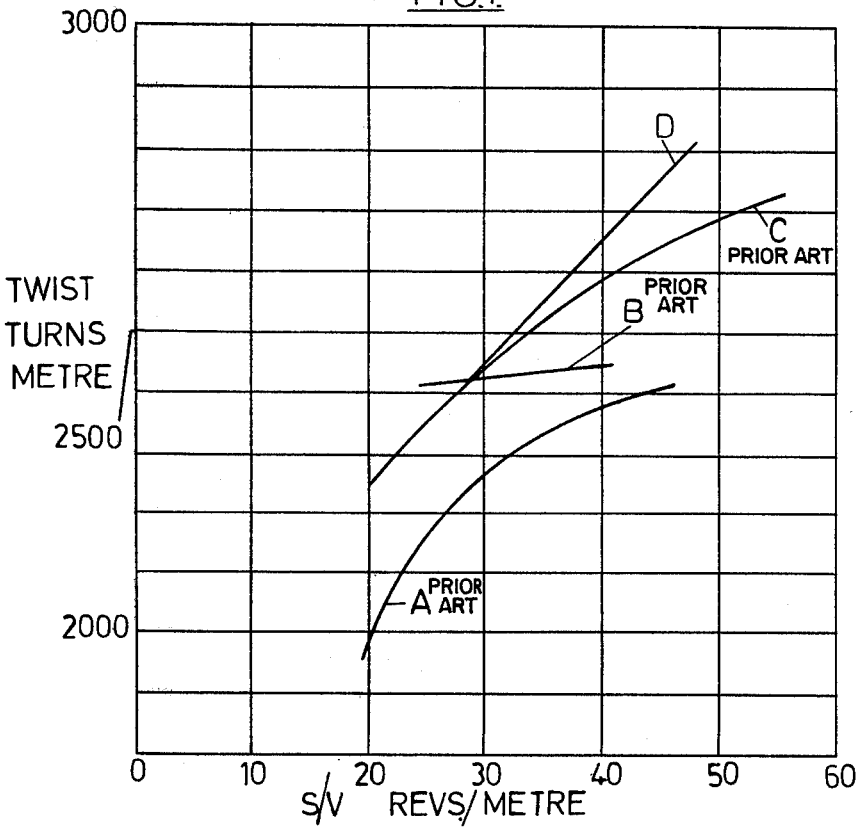
FIG. 1 is a graph of S/V versus twist level for different false-twist devices, where S is speed of rotation and V is yarn speed.

Typical of the art of friction twisting devices is the apparatus described and claimed in the UK specification No. 797,051 and devices derived therefrom such as the apparatus described in the "Hosiery Trade Journal," January 1962 at page 123, in which a relatively high friction surface or bush is located at each end of a hollow spindle of constant internal diameter. In the operation of these devices the amount of twist that can be put into a yarn is dependant, inter alia, on the ratio of the speed of rotation of the device (S) to the yarn throughput speed (V), with a maximum twist level when neither an increase in (S) nor a decrease in (V) results in higher twist levels in the yarn. FIG. 1 of the accompanying drawings shows a typical graph A of twist level against the ratio S/V for such a prior art device. Similarly graphs B and C of FIG. 1 correspond to the known friction false twist arrangements shown in FIGS. 3 and 4 respectively.

In the present invention the Applicants have sought to increase the amount of twist that can be inserted for a given S/V ratio and hence the productivity of the system, and this has been achieved by using a suitably mounted but modified conventional friction twisting device which permits the yarn to take a completely different path in passing to and from the twisting apparatus.

Accordingly the present invention provides a method for false twisting filamentary yarn using a friction false twist device comprising a rotatable hollow spindle with a friction surface or bush mounted at one end thereof in which yarn enters the spindle at the end opposite to the bush in a direction substantially parallel to the axis of rotation of the spindle and in leaving the spindle contacts the bush so that the linear surface speed thereof in contact with the yarn increases in the direction of yarn travel.

Preferably the surface speed of the bush in contact with the yarn increases by at least 50% in the direction of yarn travel. The preferred bush profile presents at least a 180° convex surface to the yarn and corresponds substantially to that shown in figures 5 and 6 of the accompanying drawings.

The direction taken by the yarn after leaving the bush is determined, inter alia, by the need to maximise contact with the friction bush and the geometry of the processing apparatus as a whole. Two possible arrangements are shown respectively in figures 5 and 6 described below; in each case the direction of travel of the yarn is reversed by its contact with the bush.

The following examples are intended only to illustrate the present invention. Apparatus similar to that shown and described in UK Specification No. 1,263,055, but where the false twist device used was of a friction type, was used as described below.

| | |
|---|---|
| Yarn | Polyester (derived from polyethylene terephthalate) 30 filaments (birefringence $6.4 \times 10^{-3}$) |
| Draw roll speed | 250 m/min |
| Draw ratio | 3.2 (drawn yarn decitex 167) |
| Contact heater | 4 ft at 200°C |
| Cooling by natural convection (distance between end of heater and false twist device) | 5 ft |
| Bush material | Compression moulded polyurethane. Shore hardness 75 (A Scale) |

The same size and shape of bush was used in all of the following Examples.

EXAMPLES 1 – 4

In these examples the friction false twist devices used correspond to those shown in FIGS. 2 – 4 and 6 respectively of the accompanying drawings.

Thus in Example 1 the device used was similar to that described in the "Hosiery Trade Journal" above where yarn entry and exit is at a substantial angle to the axis of spindle rotation. In Example 2 three rotatable bushes were used, the centre bush being offset with respect to the other two so as to cause the yarn to bear against and frictionally engage the internal surfaces of all three bushes. Like the device shown in FIG. 6, the overall direction of yarn travel remains unchanged through the device. Example 3 employed two false twist devices arranged side-by-side and is similar to the apparatus described and shown in UK Specification No. 818,950. The friction false twist device shown in FIG. 6 where the overall direction of yarn travel is substantially unchanged was used in Example 4; the yarn being passed over a rotatable ½ inch diameter pulley wheel in order to bring it into contact with the friction bush of the device. The bush had an internal diameter of 11 mm and an outside diameter of 35 mm.

Figure 5:
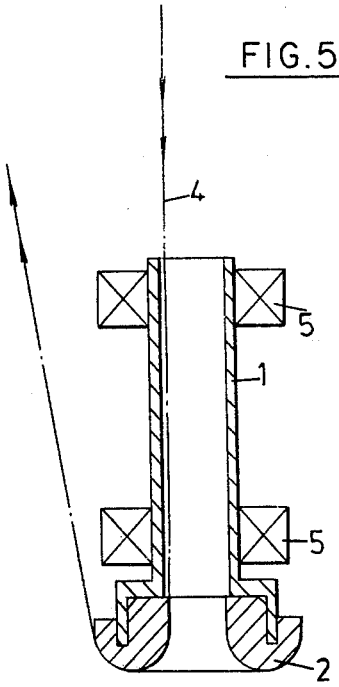
FIGS. 5 and 6 are illustrations of false twist devices embodying the principles of the present invention.
Figure 6:
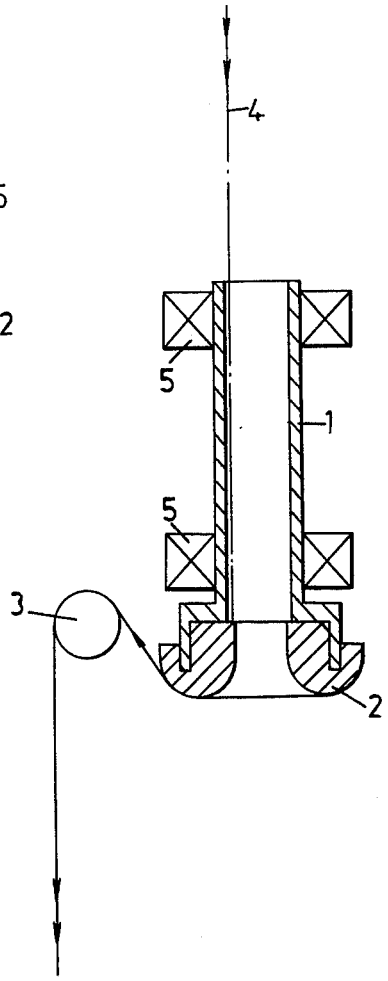

FIG. 5, which is not specifically exemplified, shows an alternative arrangement to that of FIG. 6 where the overall direction of yarn travel is substantially reversed.

In FIGS. 2 – 6 the spindle, bushes and yarn are indicated by numerals 1, 2 and 4 respectively while guide means 3 in FIG. 6 (eg a stationary pin or rotatable pulley wheel) is appropriately located with respect to the spindle to bring the yarn into frictional contact with the bush as shown. The spindle bearings 5 are conventional angular contact bearings.

A spin finish composition comprising essentially a refined mineral oil, a surfactant emulsifier and an antistat was applied to the polyester yarn prior to processing.

The twist inserted in the drawn polyester yarns was measured with a twist counter (eg as supplied by Henry Baer AG of Zurich, Switzerland — type 8B) at a number of different S/V ratios for the different false twist devices. Graphs A – D (FIG. 1) were then plotted of twist against S/V for each device.

Summary Table

Figure 2:
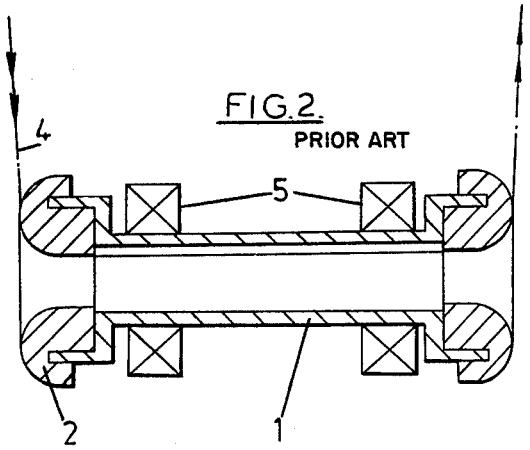
FIG.2. PRIOR ART
FIGS. 2, 3 and 4 are illustrations of prior art false twist devices.
Figure 3:
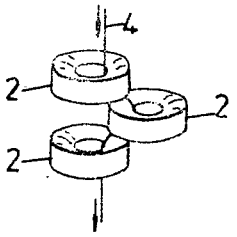
Figure 4:
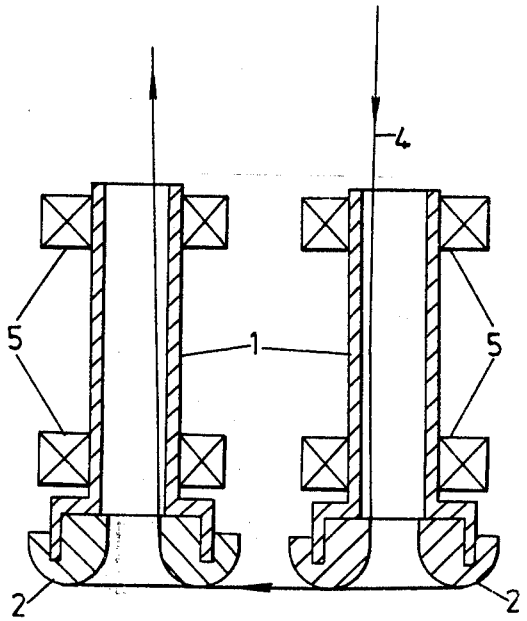

| Example | False Twist Device | Graph Twist/(S/V) |
|---|---|---|
| 1 (prior art) | FIG. 2 | A |
| 2 " | FIG. 3 | B |
| 3 " | FIG. 4 | C |

Summary Table-continued

| Example | False Twist Device | Graph Twist/(S/V) |
|---|---|---|
| 4 (invention) | FIG. 6 | D |

Two important features which clearly distinguish the value of the present invention over the prior art are apparent from these graphs:

i. all values of S/V for the device of the present invention over about 27 revs/meter give higher twist insertion, and ii. the twist produced by the best of the prior art devices (FIG. 4) begins to level off at an S/V of about 35 revs/meter while for the device according to the present invention twist is still increasing even at an S/V of 45 revs/meter.

EXAMPLE 5

In this example a partially orientated 30 filament polyester yarn (derived from polyethylene terephthalate) was processed as described in the previous examples using the device shown in FIG. 6.

| | |
|---|---|
| Yarn | Polyester (birofringence $26 \times 10^{-3}$) |
| Draw roll speed | 230 m/min |
| Draw ratio | 2.0 (drawn yarn decitex 167) |
| Contact heater | 1.5 m at 200°C |
| Cooling by natural convection | as Examples 1 – 4 |
| Bush material | as Examples 1 – 4 |

The bush was rotated at 8,800 rpm giving an S/V of 38 revs/meter and 2600 turns/meter of twist were inserted in the yarn. These results correspond with those obtained in Example 4 (Graph D).

EXAMPLE 6

Using the same equipment and, apart from an increase of draw ratio to 2.7, the same settings as in Example 5, as-spun 17 filament nylon yarn (derived from polyhexamethylene adipamide) was simultaneously drawn and false twisted. The drawn yarn decitex was 78, the S/V ratio 38 reves/meter and 3370 turns/meter of twist were inserted in the yarn. The twist factor (turns/meter $\times \sqrt{\text{dtex}}$) for the yarn, which takes into account the lower yarn decitex (compared with the previous examples), although slightly lower, corresponded favourably with that of Examples 4 and 5. A similar spin finish composition to that used above was also applied to the nylon yarn.

Though the present invention has been exemplified with respect to filamentary polyester and nylon yarns, the invention is equally applicable to a large variety of other filamentary yarns, for example, as may be derived from other synthetic materials, such as polyacrylics or polyolefins; regenerated material polymers such as cellulose acetate or viscose rayon, or inorganic materials such as glass.

Also the present invention is not limited to the processing of drawable yarns and is equally applicable to the processing of fully drawn yarns.

What we claim is:

1. A method for false twisting an advancing filamentary yarn using a friction false twist device comprising a rotatable hollow spindle with a friction surface or bush mounted at one end thereof and presenting a continuous friction surface both on the inside and on the outside of the end portion of the hollow spindle in which yarn enters the spindle at the end opposite to the bush in a direction substantially parallel to the axis of rotation of the spindle and leaves the spindle in substantially the reverse direction so that the yarn maintains continuous contact with the surface of the bush while the linear surface speed thereof increases by at least 50% in the direction of yarn travel.

2. A method as claimed in claim 1 in which polyester yarn is false twisted.

3. A method as claimed in claim 1 in which nylon yarn is false twisted.

4. A method as claimed in claim 1 in which the yarn is simultaneously drawn and false twisted.

* * * * *